US007191892B2

(12) United States Patent
Monti

(10) Patent No.: US 7,191,892 B2
(45) Date of Patent: Mar. 20, 2007

(54) APPARATUS FOR TRANSFERRING PRODUCTS FROM A FIRST CONVEYING LINE TO A SECOND CONVEYING LINE, IN PARTICULAR FOR FEEDING A BOXING MACHINE

(75) Inventor: Guiseppe Monti, Pianoro (IT)

(73) Assignee: Marchesini Group S.p.A., Pianoro (IT)

( * ) Notice: Subject to any disclaimer, the term of this patent is extended or adjusted under 35 U.S.C. 154(b) by 0 days.

(21) Appl. No.: 11/172,159

(22) Filed: Jun. 30, 2005

(65) Prior Publication Data

US 2006/0000688 A1 Jan. 5, 2006

(30) Foreign Application Priority Data

Jul. 2, 2004 (IT) ..... BO2004A0414

(51) Int. Cl.
*B65G 47/24* (2006.01)
*B65G 47/82* (2006.01)
*B21B 39/22* (2006.01)

(52) U.S. Cl. ..... 198/370.04; 198/369.3; 198/375; 198/377.1; 198/377.02; 198/379; 198/408; 198/598; 414/788.5; 414/790.2; 414/790.6; 414/792.2; 414/793.9; 414/759; 414/769; 414/775

(58) Field of Classification Search ..... 198/369.3, 198/370.04, 375, 377.1, 377.02, 379, 408, 198/598; 414/788.5, 790.2, 790.6, 792.2, 414/793.9, 759, 769, 775
See application file for complete search history.

(56) References Cited

U.S. PATENT DOCUMENTS

| | | | | |
|---|---|---|---|---|
| 3,729,085 | A | 4/1973 | Schlueter et al. | |
| 6,217,274 | B1 * | 4/2001 | Svyatsky et al. | 414/405 |
| 6,364,089 | B1 * | 4/2002 | Singh et al. | 198/408 |
| 6,398,008 | B1 * | 6/2002 | Suga | 198/404 |

FOREIGN PATENT DOCUMENTS

| | | |
|---|---|---|
| DE | 1461894 | 5/1963 |

* cited by examiner

*Primary Examiner*—Gene O Crawford
*Assistant Examiner*—Leslie A. Nicholson, III
(74) *Attorney, Agent, or Firm*—William J. Sapone; Coleman Sudol Sapone PC

(57) ABSTRACT

In an apparatus for transferring products from a first conveying line to a second line conveying line operated stepwise in a feeding direction and particularly for feeding a boxing machine a plurality of compartments are aligned along the feeding direction. Each compartment has a bottom and a pair of lateral boards. The compartments receive products released by a manipulator and taken from the first conveying line. An actuator rotates the compartments from a loading configuration for receiving the products, to an overturned configuration, in which the compartments face corresponding, dwelling seats of the second, feeding line. A holding element closes the upper part of the compartments, moving from the loading configuration up to the overturned configuration. A pusher moves into the compartments in the overturned configuration, to push the products into the facing seats of the second, feeding line.

10 Claims, 7 Drawing Sheets

M
2
3
8
7
71a
4
4a
W
4a
II
II
Y
5

APPARATUS FOR TRANSFERRING PRODUCTS FROM A FIRST CONVEYING LINE TO A SECOND CONVEYING LINE, IN PARTICULAR FOR FEEDING A BOXING MACHINE

BACKGROUND OF THE INVENTION

The present invention relates to automatic packaging of various products, in particular vials, syringes, tablets, pills, capsules and the like for pharmaceutical and/or food use, into blister packs.

In particular, the invention relates to an apparatus for transferring products, e.g. blister packs, from a first conveying line to a second conveying line for feeding a boxing machine.

BRIEF DESCRIPTION OF THE PRIOR ART

Known transferring apparatuses include manipulating means, which take products, situated within seats or in bulk, from a conveying line, and convey them into corresponding compartments of a second conveying line designed, for example for feeding a boxing machine.

The manipulating means bring one or more products into each compartment of the second conveying line, to form therein a pile of products.

An main disadvantage of the above mentioned transferring apparatuses lies in the fact that the manipulating means cannot feed directly the compartments of the second conveying line with products disposed lying on one edge.

In fact, this orientation of the products does not allow feeding a single product to each compartment of the second conveying line, due to the clear instability of the position taken by the product when released.

This fact limits remarkably the flexibility of the apparatuses in all those cases which require the release of products oriented on one edge to the second conveying line.

SUMMARY OF THE INVENTION

The object of the present invention is to propose an apparatus for transferring products from a first conveying line to a second conveying line, in particular for feeding a boxing machine, which can release products oriented on one edge to the second line.

Another object of the present invention is to propose an apparatus, which ensures high reliability and versatility standards in any operation conditions, allowing particularly rapid and easy adjustment of the production rate in relation to the packaging cycle characteristics.

A further object of the present invention is to propose an extremely functional apparatus, which assures particularly rapid and easy installation and maintenance operations.

The above mentioned objects are obtained, in accordance with the contents of the claims, by an apparatus for transferring products from a first conveying line to a second conveying line in particular for feeding a boxing machine, with said second conveying line operated stepwise in a feeding direction and having a plurality of seats for receiving products, said apparatus including:

a plurality of compartments substantially aligned with said feeding direction, each compartment of said compartments including a bottom and a pair of lateral opposite, boards extending from said bottom;

said compartments receiving products released by manipulating means for taking products from said first, conveying line and placing the articles into said compartments;

actuator means for rotating said compartments on axes substantially orthogonal to said feeding direction, from a loading configuration, in which said compartments receive the products from said manipulating means, with the bottom of each compartment substantially horizontal, to a overturned configuration, in which the compartments face the corresponding, dwelling seats of said second, conveying line, with the lower lateral boards of each compartment substantially coplanar with said seats;

holding means for closing the upper part of said compartments, moving from the loading configuration up to the overturned configuration, so as to hold the products arranged on their own edges and contained in the compartments and to allow transferring of said products to the corresponding dwelling seats of said second conveying line.

BRIEF DESCRIPTION OF THE DRAWINGS

The characteristic features of the invention will be pointed out in the following description of some preferred but not exclusive embodiments, with reference to the enclosed figures, in which.

DISCLOSURE OF THE PREFERRED EMBODIMENT

Figure 1:
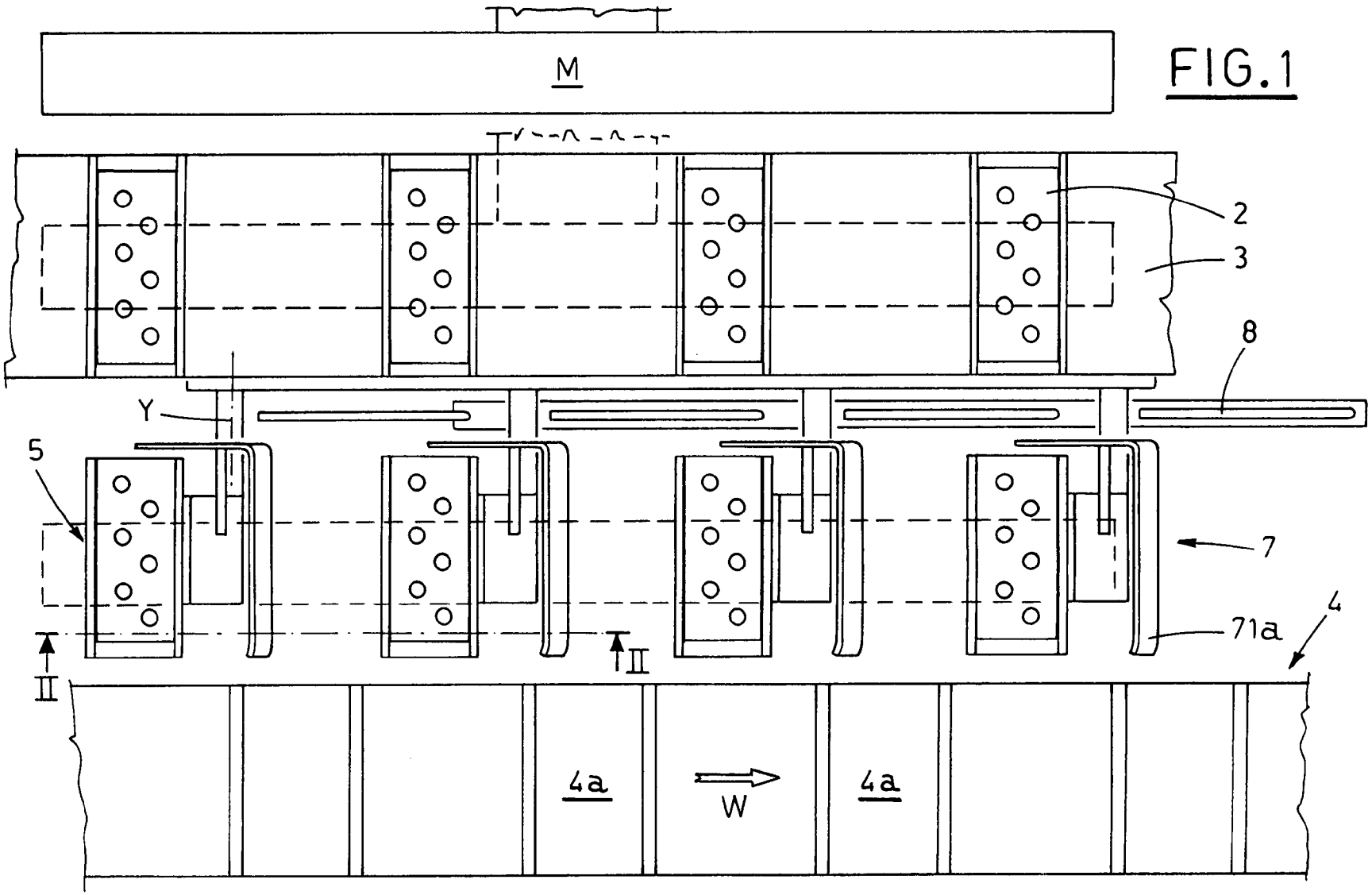
FIG. 1 is a schematic, top view of the apparatus proposed by the present invention.

Having regards the enclosed figures, the reference numeral 1 indicates the proposed apparatus for transferring products 2 from a first, conveying line 3 to a second conveying line 4, designed in particular for feeding a boxing machine (not shown).

The second conveying line 4, operated stepwise in a feeding direction W, has a plurality of seats 4*a*, which receive products 2, for example blister packs.

Likewise, for example, the first, conveying line 3 has a plurality of seats 3*a*, which receive blister packs 2.

The apparatus 1 includes a plurality of compartments 5, aligned along the feeding direction W and receiving blister packs 2 released by manipulating means M, which take the blister packs 2 from the seats 3*a* of the conveying line 3 (FIG. 1).

Each compartment 5 has a bottom 50, from which a pair of lateral, opposite side boards 5*a*, 5*b* extend. The side boards are substantially orthogonal to the bottom.

Suitable actuator means 6 rotate the compartments 5 on axes Y, orthogonal to the feeding direction W, from a loading configuration A, in which they receive the blister packs 2 from the manipulating means M, to an overturned configuration B, in which they face corresponding, dwelling seats 4*a* of the second, feeding line 4.

The loading configuration A is preferably shifted with respect to the overturned configuration B by a right angle.

Figure 2A:
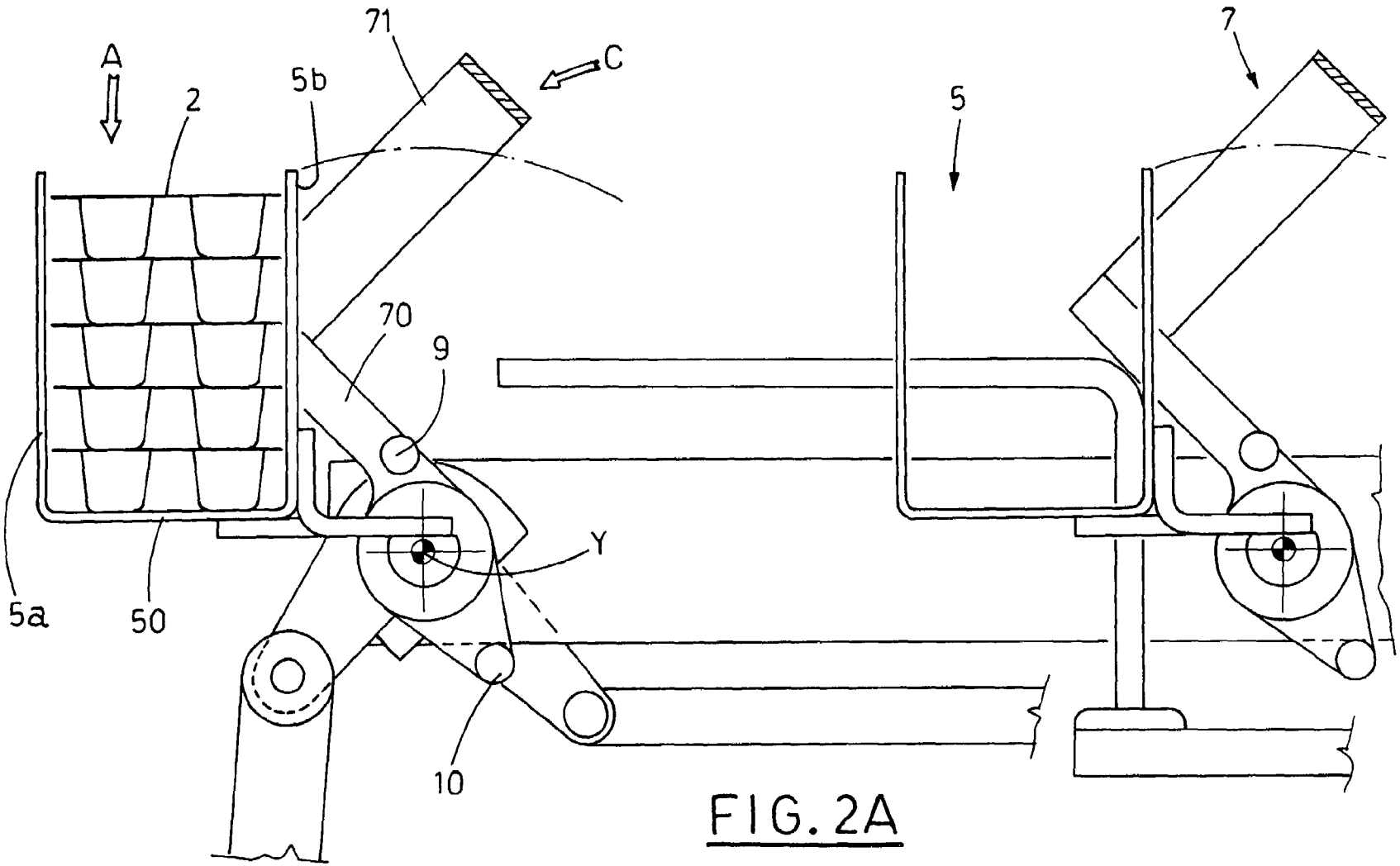
FIGS. 2A, 2B are schematic, section views, taken along the II—II of FIG. 1, of the proposed apparatus in corresponding, particularly significant operation steps.
Figure 4:
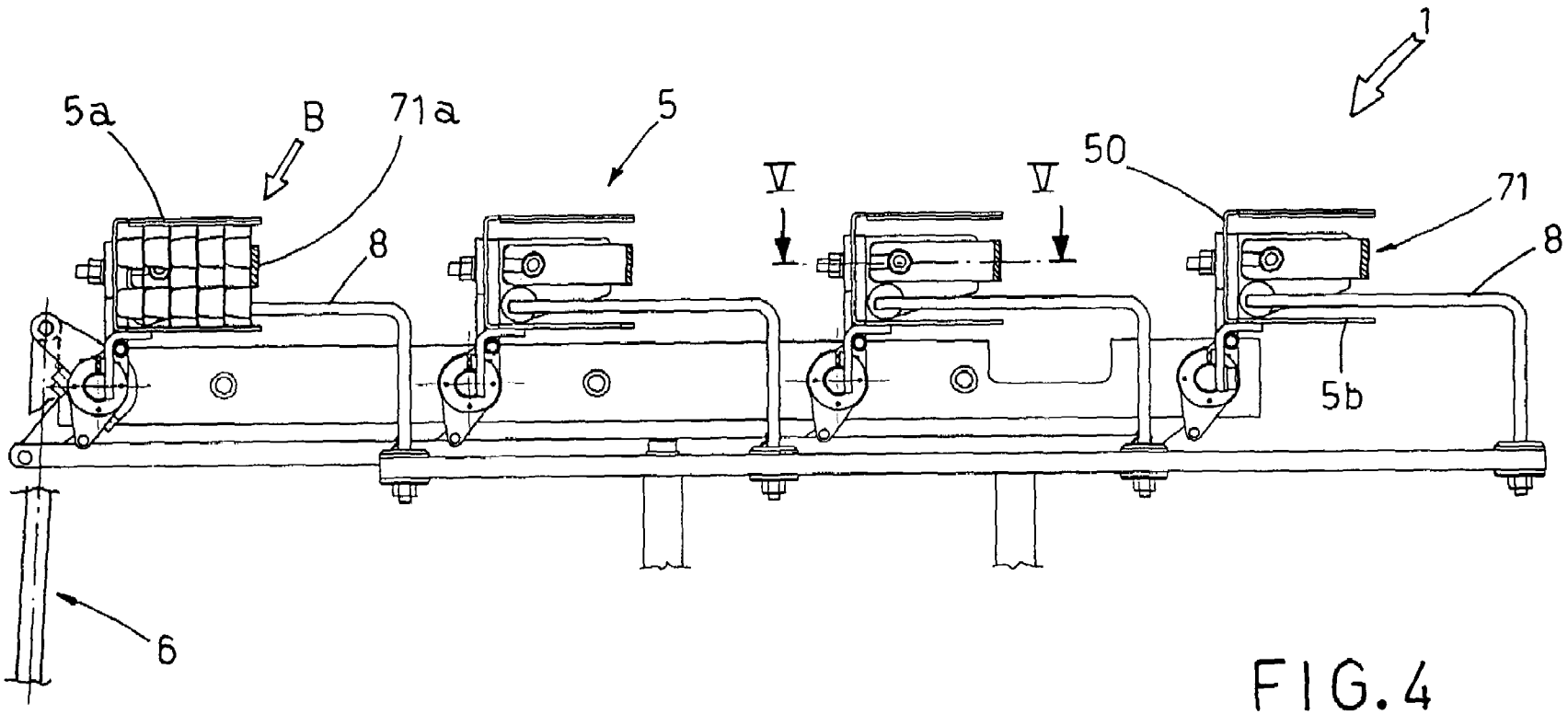
FIG. 4 is a schematic, section view, taken along the IV—IV of FIG. 3A, in a reduced scale.

In the loading configuration A, the bottom 50 of each compartment 5 is oriented horizontally, with the lateral boards 5*a*, 5*b* orthogonal to the feeding direction W, while in the overturned configuration B, the lateral lower boards 5*b* of each compartment 5 are coplanar with corresponding seats 4*a*, parallel to the feeding direction W (FIGS. 2A, 4).

The proposed apparatus 1 has also holding means 7, which close the upper part of the compartments 5 moving from the loading configuration A up to the overturned configuration B, so as to prevent the blister packs 2 from leaving the compartments 5.

Figure 3A:
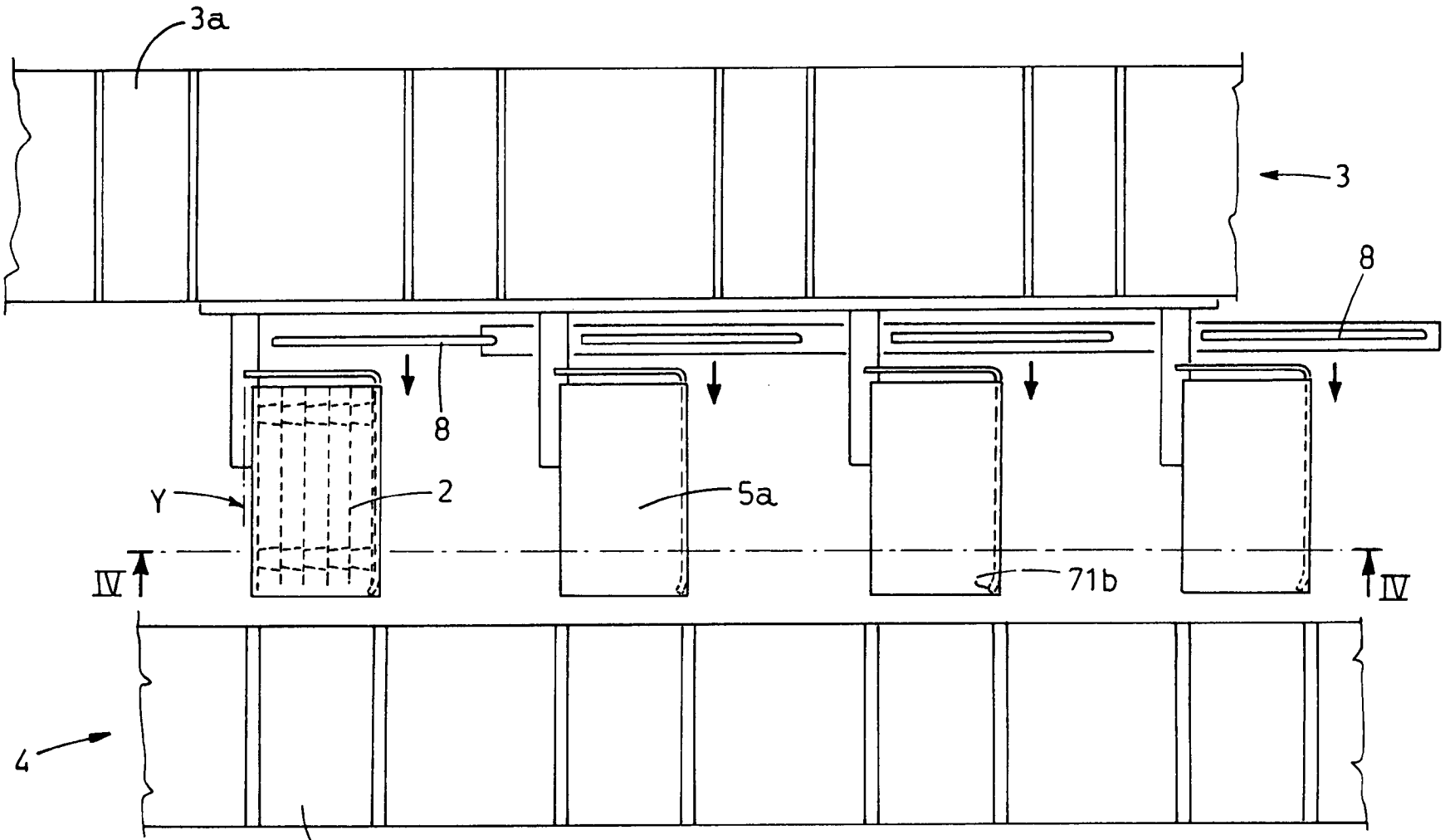
FIGS. 3A, 3B are as many schematic, top views of the proposed apparatus, in further extremely significant working steps.
Figure 3B:
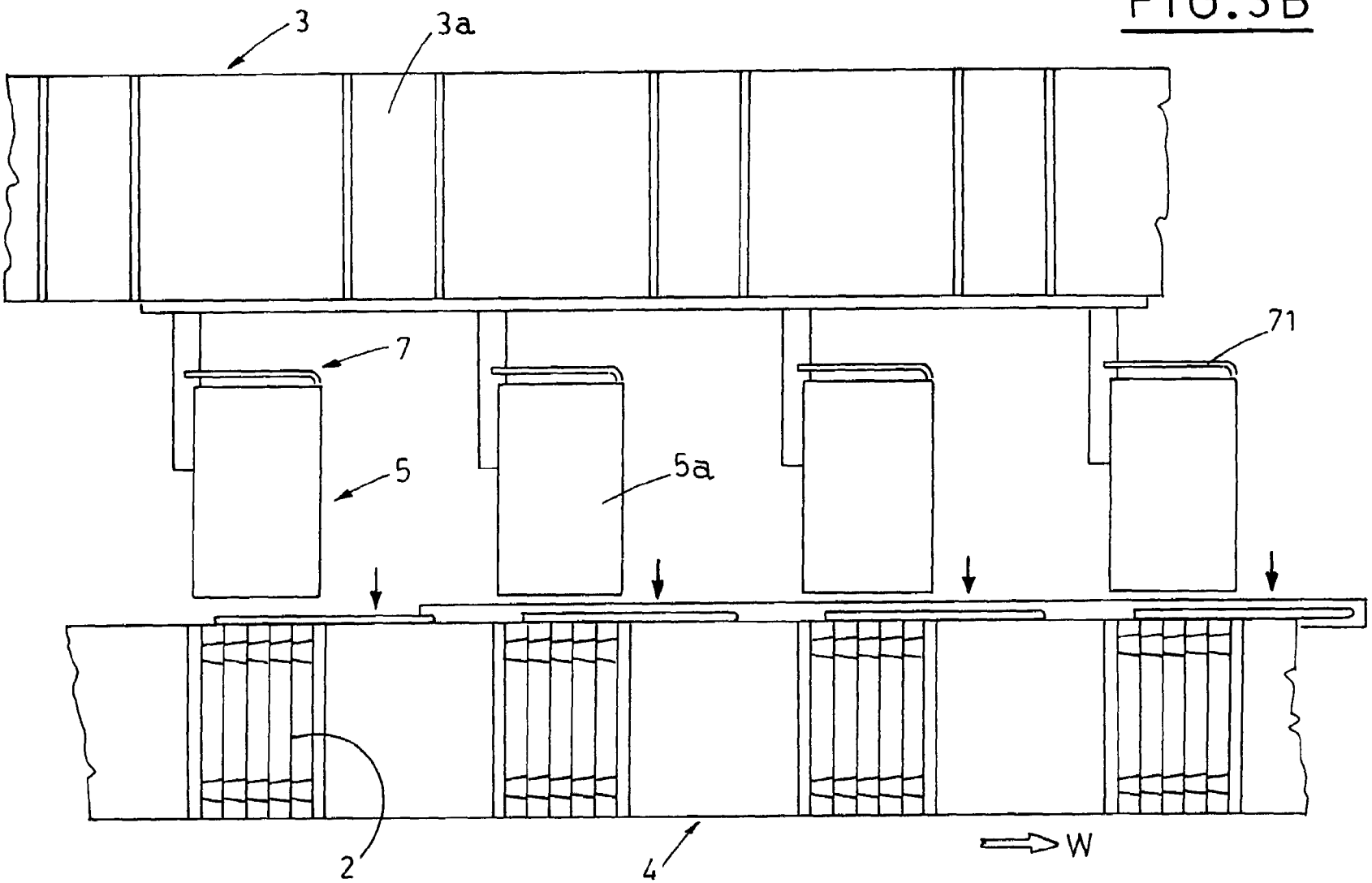

In the overturned configuration B, pusher means 8 are made to cross the compartments 5 in the portion between the respective lateral boards 5*a*, 5*b*, so as to push the blister packs 2 arranged on their own edges, contained in the compartments 5 and transfer them to the corresponding, dwelling seats 4*a* of the second, feeding line 4 (FIGS. 3A, 3B).

It is understood that, in the overturned configuration B, the pusher means 8 do not interfere with the holding means 7 in any way, because they operate e.g. below the holding means 7 (FIG. 4).

Figure 5:
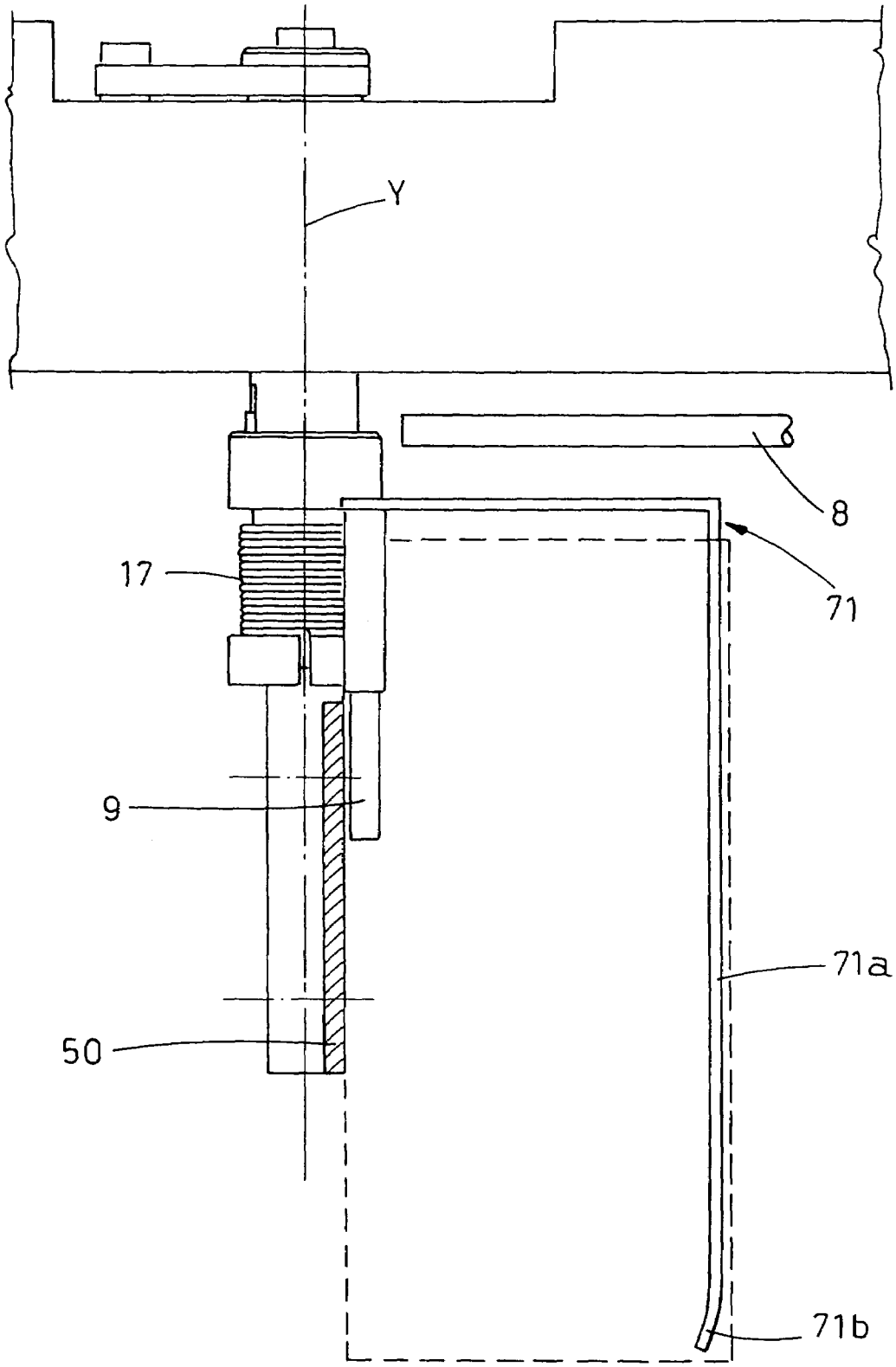
FIG. 5 is a schematic, enlarged, section view, taken along the V—V of FIG. 4.

First abutment means 10 are connected to the holding means 7 to define a waiting position C of the latter, against the relative elastic means 17 (FIGS. 2A, 5).

Second abutment means 9 are connected to the holding means 7. In the waiting position C, the compartments 5, moving away from the loading configuration A (FIG. 2B), go in abutment against the abutment means 9.

This allows the holding means 7 to be pulled, against the elastic means 17, from the waiting position C to the overturned configuration B of the compartments 5.

According to a preferred embodiment, the holding means 7 include a plurality of arms 70, from which corresponding angular elements 71 extend orthogonal thereto.

The terminal ends 71*a* of the arms 70 allow the upper part of the compartments 5 to be closed during their transition from the waiting position C up to the overturned configuration B.

The arms 70 are hinged along axes, which are orthogonal to the feeding direction W, advantageously coaxial to the rotation axes Y of the relative compartments 5.

For example, the first abutment means 10 and the second abutment means 9, and the elastic means 17 are connected to the respective arms 70.

In particular, the elastic means 17 include torsion springs, connected to the hinge axis of the arms 70.

The angular elements 71 include advantageously, in a region corresponding to the terminal ends 71*a*, bent parts 71*b*, which push the blister packs 2 against the bottoms 50 of the related compartments 5, during the transferring to the dwelling seats 4*a* of the second, feeding line 4.

Now, operation of the proposed apparatus l will be briefly described, with reference to a general operation step, in which the holding means 7 are in the waiting position C and the manipulating means M have released the prefixed number of blister packs 2 into the corresponding compartments 5 in the loading configuration A (FIG. 2A).

Figure 2B:
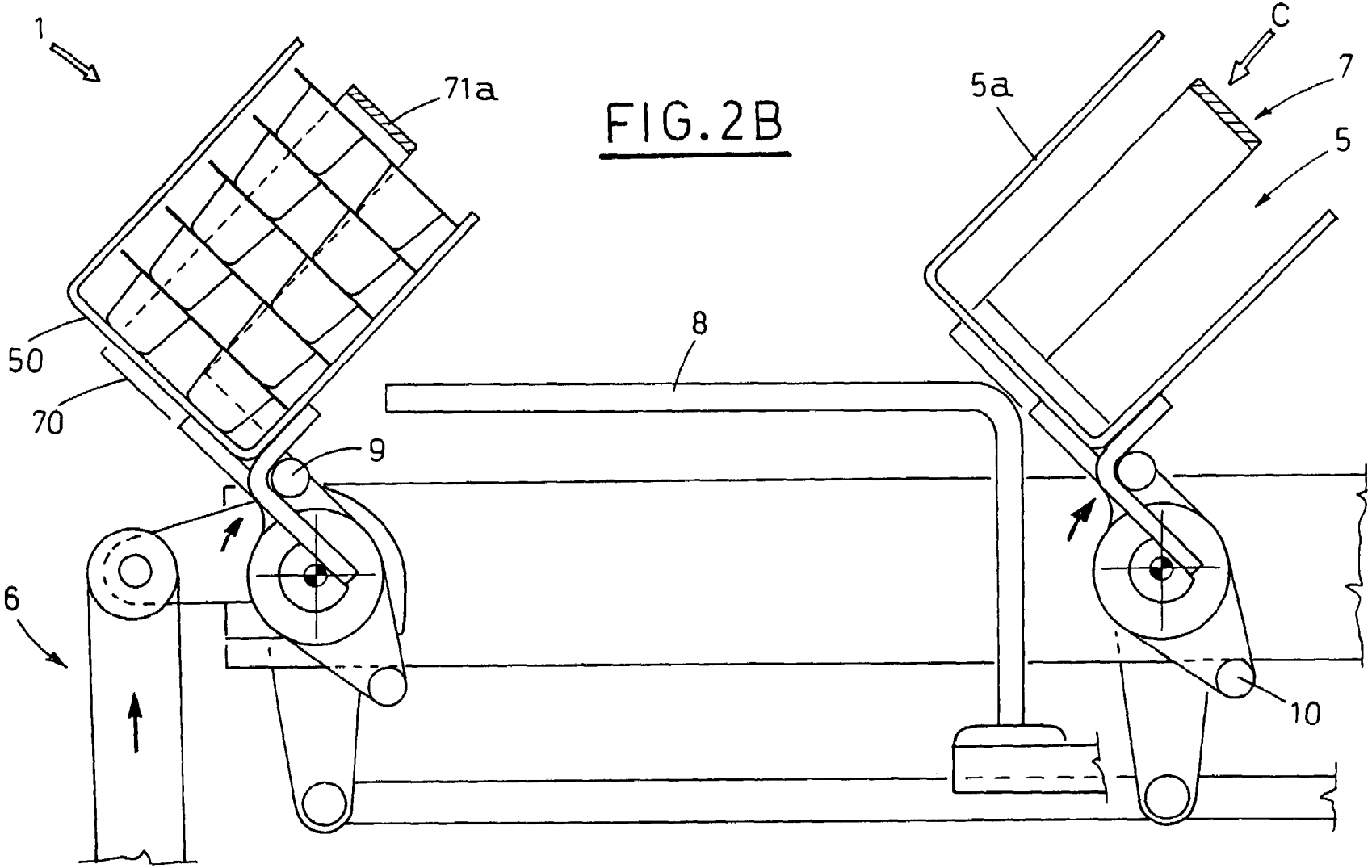

In step relation with the completion of the compartments 5 filling, the actuator means 6 operate the compartments 5 to rotate away from the loading configuration A, until they contact the second abutment means 9, connected to the arms 70, in the waiting position C, in which the terminal ends 71*a* of the angular elements 71 close the upper part of the compartments 5 (FIG. 2B).

Beginning from the waiting position C, the actuator means 6 operate the compartments 5 to rotate, pulling also the corresponding arms 70, the latter against the torsion springs, up to the overturned configuration B, in which the lower lateral boards 5*b* of each compartment 5 are coplanar with the corresponding, dwelling seats 4*a* of the second, feeding line 4 (FIG. 4).

In step relation with the reaching of the overturned configuration B, the portions of the compartments 5 included between the respective lateral boards 5*a*, 5*b*, are engaged with the pusher means 8, which push the blister packs 2 arranged on one edge, without interfering with the angular elements 71, and transfer the blister packs 2 to the corresponding, dwelling seats 4*a* of the second, feeding line 4 (FIGS. 3A, 3B).

In step relation with the transferring completion, the second, feeding line 4 is operated one step in a feeding direction W, so as to move the seats 4*a*, filled with the blister packs 2 arranged on their edges, while the actuator means 6 drive the compartments 5 to move from the overturned configuration B.

At the same time, the arms 70, subjected to the action of the torsion springs, remain together with the compartments 5, away from the overturned configuration B, up to the waiting position C, in which the first abutment means 10 disengage the arms 70 from the compartments 5, stopping them (FIG. 2B).

In step relation with the reaching of the loading configuration A of the compartments 5, the latter can receive again the blister packs 2 from the manipulating means M (FIG. 2A).

It is easy to understand from the above explanation, how the proposed apparatus for transferring products from a first, conveying line to a second line, in particular for feeding a boxing machine, can release products arranged on one edge onto the second, feeding line.

Likewise, the apparatus allows to reach high reliability and versatility standards in any working conditions, allowing particularly rapid and easy adjustments of the production rate in relation to the packaging cycle characteristics.

It is likewise important to obtain an apparatus, which is extremely functional, and which assures particularly rapid and easy installation and maintenance operations.

It is understood that the proposed invention has been described, with reference to the enclosed figures, as a mere, not limiting example. Therefore, it is obvious that any changes or variants applied thereto remain within the protective scope defined by the following claims.

What is claimed is:

1. An apparatus for transferring products from a first conveying line to a second conveying line in particular for feeding a boxing machine, with said second conveying line operated stepwise in a feeding direction and having a plurality of seats for receiving products, said apparatus comprising:

a plurality of compartments substantially aligned with said feeding direction, each compartment of said compartments including a bottom and a pair of lateral opposite, boards extending from said bottom;

said compartments receiving products released by manipulating means for taking products from said first, conveying line and placing the articles into said compartments;

actuator means for rotating said compartments on axes substantially orthogonal to said feeding direction, from a loading configuration, in which said compartments receive the products from said manipulating means, with the bottom of each compartment substantially horizontal, to a overturned configuration, in which the compartments face the corresponding, dwelling seats of said second, conveying line, with the lower lateral boards of each compartment substantially coplanar with said seats;

holding means for closing the upper part of said compartments, moving from the loading configuration up to the overturned configuration, so as to hold the products arranged on their own edges and contained in the compartments and to allow transferring of said products to the corresponding dwelling seats of said second conveying line; and, first abutment means connected to said holding means for defining a waiting position of the holding means, against elastic means connected thereto, and second abutment means, connected to said holding means so that when said holding means are in said waiting position, the compartment moving away from the loading configuration goes into abutment against said abutment means so as to pull said holding means up to said overturned configuration, against said elastic means.

2. An apparatus, as claimed in claim 1, wherein said holding means include a plurality of arms, hinged on axes; substantially horizontal to said feeding direction, from which corresponding angular elements extend, said angular elements having ends capable of closing the upper part of said compartments during their transition from the waiting position up to the overturned configuration.

3. An apparatus, as claimed in claim 2, wherein said first abutment means and second abutment means and said elastic means are connected to the arms.

4. An apparatus, as claimed in claim 2, wherein said elastic means include torsion springs connected to the hinging axis of said arms.

5. An apparatus, as claimed in claim 2, wherein said arms are hinged along axes, which are coaxial with the rotation axes of the compartments.

6. An apparatus, as claimed in claim 2, further including bent parts situated in regions corresponding to said ends of the angular elements for pushing said products against the corresponding bottoms of the compartments during transferring to the dwelling seats of the second; conveying line.

7. An apparatus, as claimed in claim 2, wherein said angular elements extend substantially orthogonal to the corresponding arms.

8. An apparatus, as claimed in claim 1, further including a plurality of seats, situated in said first conveying line and receiving products.

9. An apparatus, as claimed in claim 1, wherein the loading configuration and the overturned configuration of said compartments are offset by a substantially right angle.

10. An apparatus, as claimed in claim 1, wherein the lateral boards of said compartments extend substantially orthogonal to the corresponding bottoms.

* * * * *